US011946206B2

(12) United States Patent
Schmidt

(10) Patent No.: US 11,946,206 B2
(45) Date of Patent: Apr. 2, 2024

(54) ARTIFICIAL TURF SYSTEM AND SUPPORT LAYER

(71) Applicant: Playground Equipment Services, L.L.C., Cincinnati, OH (US)

(72) Inventor: Eric L. Schmidt, Cincinnati, OH (US)

(73) Assignee: Playground Equipment Services, L.L.C., Cincinnati, OH (US)

( * ) Notice: Subject to any disclaimer, the term of this patent is extended or adjusted under 35 U.S.C. 154(b) by 0 days.

(21) Appl. No.: 17/811,487

(22) Filed: Jul. 8, 2022

(65) Prior Publication Data

US 2024/0011226 A1 Jan. 11, 2024

(51) Int. Cl.
*E01C 13/02* (2006.01)
*E01C 13/08* (2006.01)

(52) U.S. Cl.
CPC ..... *E01C 13/08* (2013.01); *E01C 13/02* (2013.01)

(58) Field of Classification Search
CPC ..... E01C 13/02; E01C 13/08
See application file for complete search history.

(56) References Cited

U.S. PATENT DOCUMENTS 6,896,964 B2 * 5/2005 Kvesic ..... C08L 19/003 427/407.1
2012/0258811 A1 * 10/2012 Tetrault ..... C08J 3/24 252/78.3
2014/0341651 A1 * 11/2014 Van Reijen ..... E01C 13/083 428/17
2017/0081807 A1 * 3/2017 Tetrault ..... B32B 25/00
2018/0142426 A1 * 5/2018 Sawafta ..... F28D 20/00
2019/0169803 A1 * 6/2019 Fellars ..... E01C 13/02

FOREIGN PATENT DOCUMENTS

CN 102817301 A * 12/2012

* cited by examiner

*Primary Examiner* — Humera N. Sheikh
*Assistant Examiner* — Kevin C T Li
(74) *Attorney, Agent, or Firm* — Jenei LLC; Stephen R. Jenei

(57) ABSTRACT

A synthetic turf system is disclosed. The synthetic turf system comprises a synthetic turf system and a poured-in-place (PIP) rubber subsurface. The PIP rubber subsurface is poured with a mixture of rubber buffing and urethane configured to deliver improved safety, playability, and reduced maintenance requirements for the synthetic turf placed on a playing surface. The PIP rubber subsurface is made with rubber buffings combined with a binder such as polyurethane. The system further comprises a layer of compacted gravel disposed underneath the PIP rubber subsurface configured to allow drainage. The system further comprises a plurality of cooling particle infill to avoid dislodging of infill into athlete's shoes, clothes, eyes, or ears. Further, the infill is substantially free of crumb rubber infill and the system is without the use of added shock pads. Further, the system is configured to maintain a consistent concussion resistance throughout the entire playing surface.

11 Claims, 2 Drawing Sheets

ARTIFICIAL TURF SYSTEM AND SUPPORT LAYER

TECHNICAL FIELD

The present invention generally relates to synthetic turf systems. More specifically, the present invention relates to an improved synthetic turf system incorporating poured rubber subsurface configured to deliver athletic sports performance and safety for the athletes.

BACKGROUND

Turf is a surface material used to imitate grass. The traditional turf is made of plastic grass, shock pad, and crumb rubber as infill material deposits. Artificial turf or 'synthetic turf' is generally made of plastic blades of grass, backing material to hold the blades, and infill (usually crumb rubber that helps support the blades). Crumb rubber is the end result of shredding and grinding retired tires until the pieces are the size of a large grain of sand. Producing crumb rubber is a way of recycling used tires that would have otherwise ended up in landfills. It is estimated that 40,000 shredded waste tires are used to create the infill for just one artificial turf field. Crumb rubber infill is estimated to be about 90% of the weight of fields, thus forming the vast majority of the playing surface.

The traditional turf needs to have a long pile of turfs to hold the crumb rubber infill, which further increases the surface temperature and retains a lot of heat. Artificial turf is frequently 40 to 70 degrees F. hotter than grass, which rarely gets over 100 degrees. The that can easily get to 150 degrees on a normal warm, sunny day. Essentially, the materials comprising most synthetic turf systems absorb heat from the sun and retain the heat in the ground to a much greater extent than natural grass coverings.

Sand and rubber granules have been used as infill to increase footing and playability of athletic fields, but such infill materials do not mitigate heating issues of infill artificial tuft. In fact, rubber infill may actually contribute to increasing the temperature of the artificial turf.

In a traditional artificial turf field, it is necessary to regularly replenish the crumb rubber infill and brush the turf. Further, the crumb rubber infill deposits get dispersed, causing the loss of head impact criteria (HIC). Moreover, traditional turf may also require frequent maintenance. However, the traditional turf system is difficult to maintain and may have unacceptable disbursement and dislodging into athlete's cleats, shoes, clothing, eyes, or ears. Further, the existing turf systems do not have a consistent HIC rating, and the traditional turf systems have often dangerous heat retention.

In light of the above-mentioned drawbacks, there is a need for a synthetic turf system that has enhanced athletic sports performance and player protection without the use of a crumb rubber infill or shock pads. In addition, there is also a need for a cooler turf system. In addition, there is a need for a turf system that delivers better and more consistent performance, safety, and playability. Further, there is a need for a turf system that requires less maintenance.

SUMMARY

The present invention generally discloses synthetic turf systems. More specifically, the present invention relates to an improved synthetic turf system that incorporates a layer of poured rubber underneath the artificial playing surface to deliver vastly improved athletic sports performance and player concussion protection substantially without the need for a rubber crumb infill or shock pads.

Typically, traditional artificial turf fields have about 6-8 pounds crumb rubber infill per square foot of turf. The crumb rubber is typically a black crumb rubber which is a heat absorber contributing to the high heat load. The crumb rubber used for turf infill has traditionally been styrene-butadiene rubber (SBR), ethylene propylene diene monomer (EPDM) rubber and thermo-elastic polymer (TPE) infills.

According to the present invention, the synthetic turf system is a next generation turf system that delivers improved athletic sports performance and player protection. The system is a unique solution that has been designed to deliver improved athletic sports performance and player protection. In one or more embodiments, the system has an organic antimicrobial infill system, which substantially eliminates the usage of dispersed crumb rubber infill while improving impact and concussion performance.

In one or more embodiments, the system comprises an artificial turf system comprising a backing layer and a synthetic turf having a plurality of synthetic turf strands attached to the backing layer.

The backing layer may be comprised of any known woven, non-woven, or spun-bonded fabric to which grass-like filaments may be attached. Examples of conventional backing layers include woven warp type strands or slit film and cross or woof type strands or slit film to produce a woven sheet. It is preferred that the backing layer comprise of a stable, weather resistant material such as polyolefins, nylon, or similar material. The backing layer is preferably supple and flexible such that it may conform to the foundation layer and potentially give when impacted. The backing layer may also include one or more openings for movement of fluids such as, for example, water.

Grass-like filaments are attached to the backing layer such that the grass-like filaments extend substantially upward, away from the foundation and backing layer. The grass-like filaments may be groups of filaments individually attached to the backing layer or thick individual filaments that are split at the top to give the appearance of numerous individual fibers. The grass-like filaments may vary in thickness and size to give an appearance of natural grass. Typically, the grass-like filaments are comprised of one or more polyolefins, one or more nylons, or the like.

In one embodiment, the system further comprises a poured-in-place (PIP) rubber subsurface or base layer situated beneath the synthetic turf. The rubber subsurface or base layer, also known as the impact attenuation layer. This layer is typically made of recycled SBR rubber, or tire buffings, a byproduct of retreading commercial tires. The base layer varies in thickness based on the fall height of the equipment that it surrounds. This property is called the critical fall height. For example, if the fall height of the surface required is 4 feet, the critical fall height of the base layer must be at least 4 feet for it to comply with ASTM and CPSC codes. The PIP rubber base layer acts as a shock layer, which can absorb impacts. In one embodiment, the PIP rubber subsurface is porous and acts as a drainage layer moving moisture to the subsurface In one embodiment, the synthetic turf backing layer is situated on top of the PIP rubber subsurface as free floating. In one embodiment, the synthetic turf backing layer is situated on top of the PIP rubber subsurface as partially or fully attached by adhesive. In one embodiment, the synthetic turf backing layer is situated on top of the PIP rubber subsurface as partially or fully attached by a rolled or tucked edge.

In one embodiment, the PIP rubber subsurface comprises rubber buffing and a binder such that the PIP rubber subsurface is not dispersed. Rubber buffings are thin pieces of tire rubber produced by buffing the tread of a tire, most often a truck tire, during the retreading production process. Buffings are used extensively in pour-in-place playground systems, bonded landscape surfaces, molded rubber products, and landscape rubber bark. In one embodiment, the rubber buffing is styrene-butadiene rubber (SBR) mixed with a binder and poured in place to form a foundation underneath the backing layer, which holds the synthetic grass blades. In another embodiment, the system is installed next to the grass. In another embodiment, the system is installed next to a fixed curb.

In one or more embodiments, the system comprises a backing layer and a synthetic turf having a plurality of synthetic turf strands. In one embodiment, the system further comprises a poured-in-place (PIP) rubber subsurface. The PIP rubber subsurface is placed beneath the backing layer and may be secured to the backing or the backing may be left to float free in place. In one or more embodiments, the poured-in-place (PIP) rubber subsurface cannot be substantially dispersed such that the subsurface stays in place without being substantially disturbed creating greatly uneven thicknesses.

In another embodiment, the PIP rubber subsurface is secured to the backing layer using a glue or adhesive layer. In another embodiment, the PIP rubber subsurface is substantially free of crumb rubber infill and shock pads.

In one embodiment, the PIP rubber subsurface is treated with polyurethane. In one embodiment, the PIP rubber subsurface is poured with a mixture of rubber buffing and urethane configured to deliver improved safety, playability, and reduced maintenance requirements for the synthetic turf that is placed on a playing surface. In one embodiment, the mixture utilizes 8 to 32 pounds of urethane per 100 pounds of rubber buffing. In one or more embodiments, the mixture utilizes 1:10 to 1:4 binder (such as polyurethane) to rubber ratio. In one or more embodiments, the mixture utilizes a 1:10, 1:9, 1:8, 1:7, 1:6, 1:5, or 1:4 binder (such as polyurethane) to rubber ratio. In one or more embodiments, the binder (such as polyurethane) constitutes 5 wt. % to 30 wt. % of the final subsurface. In one or more embodiments, the binder (such as polyurethane) comprises at least 5, 6, 7, 8, 9, 10, 11, 12, 13, 14, 15 wt. % or more of the final subsurface. In another embodiment, the binder (such as polyurethane) comprises at most 30, 25, 20, 19, 18, 17, 16, 15, 14, 13, 12, 11, 10 wt. % or less of the final subsurface.

In one embodiment, the synthetic turf is attached to the PIP rubber subsurface by free floating. In another embodiment, the synthetic turf is attached to the PIP rubber subsurface using a full-spread adhesive. In another embodiment, the synthetic turf is attached to the PIP rubber subsurface using a partial-spread adhesive. In another embodiment, the synthetic turf is attached to the PIP rubber subsurface using a rolled edge. In another embodiment, the synthetic turf is attached to the PIP rubber subsurface using a tucked edge.

In one embodiment, the present invention relates to a method of cooling synthetic surfacing systems by coating the surfacing materials with a water absorbing material comprising one or more superabsorbent polymer composition in order to enable water retention within the surfacing for cooling. In one or more embodiments, the surfacing is treated or coated with one or more water-absorbing material composition may be prepared by dipping, spraying, and/or coating an aqueous solution of a water-absorbing material. In one embodiment, the water-absorbing material comprises surface-treatment agents, superabsorbent materials, or mixtures thereof. In one embodiment, the superabsorbent materials are one or more superabsorbent polymers. In one embodiment, the one or more superabsorbent polymers are formed from an acrylic monomer and cross-linking agent coated onto the surfacing material substrate. In an exemplary embodiment, the superabsorbent polymer is created using an acrylic monomer solution is in the form of the partially neutralized acrylic acid. In one embodiment, the system further comprises a plurality of cooling particles mixed with the rubber buffing.

In one embodiment, the synthetic turf has a dimension of about 0.5" to 3.5" pile or synthetic turf strand height per specification. In another embodiment, the synthetic turf has a dimension of about 1" to 3" pile or synthetic turf strand height. In another embodiment, the synthetic turf has a dimension of about 1" to 2.5" pile or synthetic turf strand height. In another embodiment, the synthetic turf has a pile or synthetic turf strand height of less than about 3, 2.5, 2, or 1.5 inches or less.

In one embodiment, the PIP rubber subsurface is poured with a mixture of rubber buffing and urethane configured to deliver improved safety, playability, and reduced maintenance requirements for the synthetic turf placed on the playing surface. The PIP rubber subsurface is poured or troweled on the ground structure or site.

The head injury criterion (HIC) is a measure of the likelihood of head injury arising from an impact. HIC includes the effects of head acceleration and the duration of the acceleration. Large accelerations may be tolerated for very short times. At a HIC of 1000, there is an 18% probability of a severe head injury, a 55% probability of a serious injury and a 90% probability of a moderate head injury to the average adult. In one study, concussions were found to occur at HIC=250 in most athletes.

In one embodiment, the synthetic turf of the present invention includes a consistent head injury criterion (HIC) rating less than 1000, 900, 800, 700, 600, 500, 400, 300, 200, or less. In one embodiment, the synthetic turf of the present invention includes a consistent head injury criterion (HIC) rating (i.e., the HIC remains constant all the time, even throughout the competition). Fully bonded HIC allows for consistent concussion resistance from 2' to 10' depending on design specifications.

In one embodiment, the synthetic turf is about 30 to 50 degrees cooler than the traditional turf systems with no exposed rubber particles such as SBR or ethylene propylene diene monomer (EPDM). In one embodiment, the cooling particle infill 104 has anti-microbial properties. In one embodiment, the system further maintains consistent concussion resistance throughout the entire playing surface.

In one embodiment, the synthetic turf infill is substantially free of ambient rubber particles. In one embodiment, the synthetic turf infill comprises at most 15, 12, 10, 9, 8, 7, 6, 5, 4, 3, 2, 1% or less of rubber particles or crumb rubber. In another embodiment, the synthetic turf infill is substantially free of rubber particles or crumb rubber, which means comprising less than 5, 4, 3, 2, 1% or less of rubber particles or crumb rubber. In another embodiment, the synthetic turf infill comprises less than 5% rubber particles or crumb rubber. In another embodiment, the synthetic turf infill comprises less than 2% rubber particles or crumb rubber. In another embodiment, the synthetic turf infill comprises less than 1% rubber particles or crumb rubber.

In one embodiment, the PIP rubber subsurface buffings have a dimension of about (for 4 mesh), 0.0787" (for 10 mesh), 0.473" (for 16 mesh), or mixtures thereof. The 4 mesh has the ability to retain about 0-10% particles. The 10 mesh has the ability to retain about particles. The 16 mesh has the ability to retain about 40-60% particles. The pan has the ability to retain about 0-5% particles. U.S. mesh size (or U.S. sieve size) is defined as the number of openings in one square inch of a screen. For example, a 36-mesh screen will have 36 openings while a 150-mesh screen viii have 150 openings. Since the size of screen (one square inch) is constant, the higher the mesh number the smaller the screen opening and the smaller the particle that will pass through. Generally US mesh is measured using screens down to a 325-mesh (325 openings in one square inch). In one embodiment, the PIP rubber subsurface buffings are sized larger than 10, 8, 6, 4 mesh or larger. In another embodiment, the PIP rubber subsurface buffings are sized smaller than about 2", 1.5", 1" or less. In another embodiment, the PIP rubber subsurface buffings are sized from about 2" pieces to 30 mesh dust sized particles. In another embodiment, the PIP rubber subsurface buffings are sized from about 1 mm to 55 mm. In another embodiment, the PIP rubber subsurface buffings are sized from about 1 mm to 42 mm. In another embodiment, the PIP rubber subsurface buffings are sized from about 1 mm to 32 mm. In another embodiment, the PIP rubber subsurface buffings are sized about 2-14 mesh. In another embodiment, the PIP rubber subsurface buffings are sized about 4-10 mesh.

In one embodiment, the PIP rubber subsurface is the key component for delivering performance, playability, and safety for the athletes while greatly decreasing the amount of maintenance required. In one embodiment, the material itself provides buoyancy and the voids in the impact course range between 0.1 and 0.4 inches. In one embodiment, the synthetic turf is installed next to the grass. In one embodiment, the synthetic turf is installed or glued to a horizontal and sloped buffing area or PIP rubber subsurface (i.e., cushion) above the ground structure. In one embodiment, the PIP rubber subsurface is about 1" to 4" in thickness.

In one embodiment, the synthetic turf system further comprises a first sub-layer foundation underneath the PIP rubber subsurface configured to allow water to pass through easily. In one embodiment, the first sub-layer is compacted gravel layer. The first sub-layer foundation may be bare ground, gravel, sand, rubber, construction materials, or a combination thereof with stone or other similar materials in order to provide support and adequate drainage for the synthetic turf system. The foundation may be slightly angled towards strategically placed drainpipes to better and faster drying of the synthetic turf system's top surface after rain or melted snow.

In one embodiment, the synthetic turf extends down the slope of the PIP rubber subsurface and the first sub-layer. In one embodiment, the first sub-layer may include the compacted gravel of about 4" deep above the ground structure. In one embodiment, a dirt backfill holds the synthetic turf to the PIP rubber subsurface. The synthetic turf is at the same finished grade (or slightly higher) than natural grass.

In one embodiment, the system further comprises a second sub-layer underneath the first sub-layer. The second sub-layer is sub-grade water drainage to drain the water as needed. In one embodiment, the drainage percolates water at a rate of at least 0.1, 0.2, 0.3, 0.4, 0.5, 0.6, 0.7, 0.8, 0.9, 1, 2, 3, 4, or 5 gallons per minute per square foot or more. In another embodiment, the drainage percolates water at a rate of 5-50 gallons per minute per square yard or more. In another embodiment, the drainage percolates water at a rate of 10-40 gallons per minute per square yard or more.

Natural grass may be grown within and through the synthetic turf system. The natural grass may provide a more realistic appearance to the synthetic turf system. The synthetic turf system may further comprise nutrients for natural grass.

The synthetic turf system may further comprise an underground sprinkler system for applying water to the super absorbent polymers as needed, one or more thermal probes for determining the temperature of the synthetic tuft systems, or a combination thereof. The one or more thermal probes may be a thermocouple system in substantial contact with the synthetic turf system and would allow remote monitoring of the installation.

The above summary contains simplifications, generalizations, and omissions of detail and is not intended as a comprehensive description of the claimed subject matter but, rather, is intended to provide a brief overview of some of the functionality associated therewith. Other systems, methods, functionality, features, and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION OF EXAMPLE EMBODIMENTS

Figure 1:
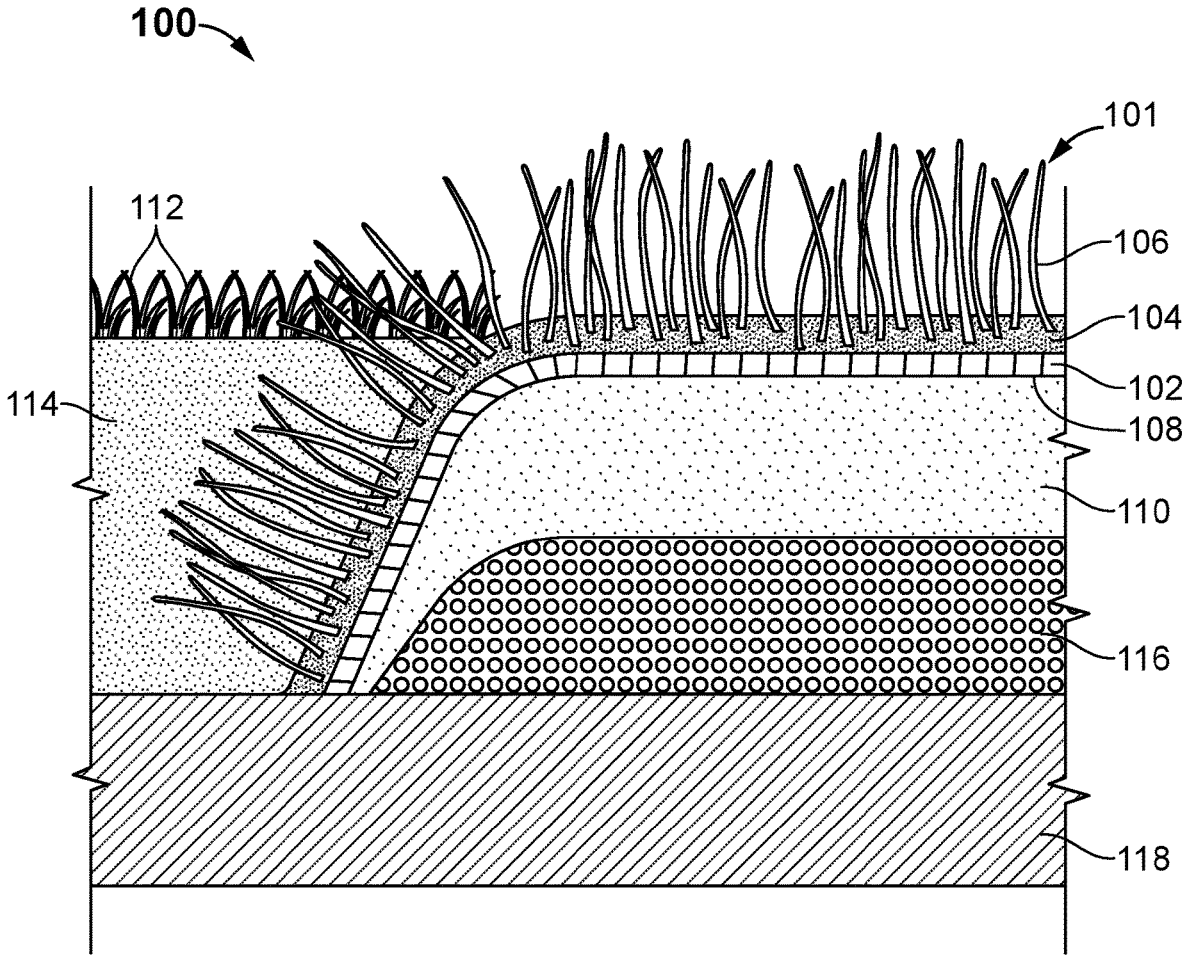
FIG. 1 shows a synthetic turf system installed next to the grass in an embodiment of the present invention.

Before describing the present invention in detail, it is to be understood that this invention is not limited to particularly exemplified systems or process parameters as such may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent, or patent application was specifically and individually indicated as incorporated by reference.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

Definitions

As used in the present specification, the following words and phrases are generally intended to have the meanings as set forth below, except to the extent that the context in which they are used indicates otherwise.

"Binders" as used herein, refers to be any binder known to those skilled in the art which interacts with rubber particles and binds the rubber particles into a cohesive unit, e.g., when the binder is exposed to air for a certain amount of time. Binder or binding agent refers to a material having binding, adhesive, or attachment properties with or without chemical, thermal, pressure or other treatment. An example of a common binder used in this field is polyurethane. Two other types of common binders are SBR and acrylic binders. SBR binders are often used to increase sealing performance with oils. SBR binders generally will cause a material to swell or expand when in contact with oils. This property provides increased sealing performance by allowing the material to seal potential leak paths in an application. SBR materials offer better sealing performance with less-than-ideal sealing flange surfaces, or between dissimilar sealing surfaces, such as a stamped-pan sealing against a cast surface area. H&V material grade names that begin with the letter "S" use an SBR binder system. Acrylic binders are similar to those used in paints.

The term "infill" as used herein refers to particulate matter generally made up of fine granules of stone, gravel, sand, asphalt, cement, ceramic beads, soil, clay, diatomaceous earth, perlite, silica, organic minerals, rubber, or combinations thereof. Such particulate infill may be positioned between and around the grass-like filaments of thew artificial turf. In various exemplary embodiments of the present invention, when combining more than one type of particulate, the particulate infill is substantially homogeneous. That is, for example, it is preferred in various exemplary embodiments that the particulate infill not be divided into various layers of materials. The particulate infill materials, in conjunction with the grass-like filaments attached to the backing layer 102 layer, tend to mutually stabilize and hold one another in predetermined position.

In one embodiment, the infill may be comprised of a metallic material, a ceramic material, a stone material, a mineral material, a hard plastic material, or any other hard material. In another embodiment, the infill comprises a granular material. In one embodiment, the infill is a particle of sand, and in another embodiment, quartz sand. In another embodiment, the infill is a particle of sand, which is coated with a water-absorbing material. In one embodiment, the water-absorbing material is a super absorbent polymer. In another embodiment, the superabsorbent polymer (SAP) in the infill of synthetic turf provides a source of water for evaporative cooling of the turf surface during hot weather. In another embodiment, the particles of water-absorbing material coated granular material have a median size that is within a range of about 5 to about 60 mesh. More preferably, both types of particles have a median size that is substantially within a range of about 10 to about 45 mesh. In another embodiment, the particles of water-absorbing material coated granular material are fabricated so that the water-absorbing material coating comprises about 0.2% to about 10% by weight of core of granular material. In another embodiment, the water-absorbing material coating comprises about 0.4% to about 5.0% by weight of the granular material. In another embodiment, the water-absorbing material coating comprises about 0.6% to about 3.0% by weight of the core of granular material. The granular material is preferably quartz sand and is preferably of an overall grain diameter in the range of about 0.0001 inches to about 0.2 inches, and in another embodiment, in the range of about 0.001 inches to about 0.1 inches, and most preferably in the range of about 0.015 inches to about 0.05 inches. In some embodiments, the infill layer may comprise an acrylic-coated sand.

"Polymer" as used herein, refers to a series of repeating monomeric units that have been cross-linked or polymerized. Any suitable polymer can be used to carry out the present invention. It is possible that the polymers of the invention may also comprise two, three, four or more different polymers. In some embodiments, of the invention only one polymer is used. In some preferred embodiments a combination of two polymers are used. Combinations of polymers can be in varying ratios, to provide polymer coatings with differing properties. Those of skill in the art of polymer chemistry will be familiar with the different properties of polymeric compounds. Examples of polymers that may be used in the present invention include, but are not limited to polycarboxylic acids, cellulosic polymers, proteins, polypeptides, polyvinylpyrrolidone, maleic anhydride polymers, polyamides, polyvinyl alcohols, polyethylene oxides, glycosaminoglycans, polysaccharides, polyesters, polyurethanes, polystyrenes, copolymers, silicones, polyorthoesters, polyanhydrides, copolymers of vinyl monomers, polycarbonates, polyethylenes, polypropylenes, polylactic acids, polyglycolic acids, polycaprolactones, polyhydroxybutyrate valerates, polyacrylamides, polyethers, polyurethane dispersions, polyacrylates, acrylic latex dispersions, polyacrylic acid, mixtures and copolymers thereof. The polymers of the present invention may be natural or synthetic in origin, including gelatin, chitosan, dextrin, cyclodextrin, poly(urethanes), Poly(siloxanes) or silicones, Poly(acrylates) such as poly(methyl methacrylate), poly(butyl methacrylate), and Poly(2-hydroxy ethyl methacrylate), Poly(vinyl alcohol) Poly(olefins) such as poly(ethylene), poly(isoprene), halogenated polymers such as Poly(tetrafluoroethylene)—and derivatives and copolymers such as those commonly sold as Teflon products, Poly(vinylidine fluoride), Poly(vinyl acetate), Poly(vinyl pyrrolidone), Poly(acrylic acid), Polyacrylamide, Poly(ethylene-co-vinyl acetate), Poly(ethylene glycol), Poly(propylene glycol), Poly(methacrylic acid); etc.

"Performance-enhancing active" or "Performance-enhancing additive" as used herein, refers to any additive which is desirable to add to the turf and/or infill particles including an antimicrobial, an odor reducing material, a binder, a fragrance, a color altering agent, a dust reducing agent, a nonstick release agent, a superabsorbent material, cyclodextrin, zeolite, activated carbon, a pH altering agent, a salt forming material, a ricinoleate, silica gel, UV stabilizers or protectants, crystalline silica, activated alumina, an anti-clumping agent, and mixtures thereof. Performance-enhancing actives that inhibit the formation of odor include a water-soluble metal salt such as silver, copper, zinc, iron, and aluminum salts and mixtures thereof. In one embodiment, the performance-enhancing additive is sprayed onto the particles. In another embodiment, the performance-enhancing additives are dry-blended with the particles. In another embodiment the performance enhancing additive is blended with an elastomeric material than ground into particles.

"Playground" describes an area either indoors or outdoors where people; especially but not solely children play; optionally using playground apparatus such as slides and swings. The term also covers areas where walking, games or physical exercises are carried out.

"Polymer" as used herein, refers to a series of repeating monomeric units that have been cross-linked or polymerized. Any suitable polymer can be used to carry out the present invention. It is possible that the polymers of the invention may also comprise two, three, four or more different polymers. In some embodiments, of the invention only one polymer is used. In some preferred embodiments a combination of two polymers are used. Combinations of polymers can be in varying ratios, to provide coatings with differing properties. Those of skill in the art of polymer chemistry will be familiar with the different properties of polymeric compounds. Examples of polymers that may be used in the present invention include, but are not limited to polycarboxylic acids, cellulosic polymers, proteins, polypeptides, polyvinylpyrrolidone, maleic anhydride polymers, polyamides, polyvinyl alcohols, polyethylene oxides, glycosaminoglycans, polysaccharides, polyesters, polyurethanes, polystyrenes, copolymers, silicones, polyorthoesters, polyanhydrides, copolymers of vinyl monomers, polycarbonates, polyethylenes, polypropylenes, polylactic acids, polyglycolic acids, polycaprolactones, polyhydroxybutyrate valerates, polyacrylamides, polyethers, polyurethane dispersions, polyacrylates, acrylic latex dispersions, polyacrylic acid, mixtures and copolymers thereof. The polymers of the present invention may be natural or synthetic in origin, including gelatin, chitosan, dextrin, cyclodextrin, poly(urethanes), Poly(siloxanes) or silicones, Poly(acrylates) such as poly(methyl methacrylate), poly(butyl methacrylate), and Poly(2-hydroxy ethyl methacrylate), Poly(vinyl alcohol) Poly(olefins) such as poly(ethylene), poly(isoprene), halogenated polymers such as Poly(tetrafluoroethylene)—and derivatives and copolymers such as those commonly sold as Teflon products, Poly(vinylidine fluoride), Poly(vinyl acetate), Poly(vinyl pyrrolidone), Poly(acrylic acid), Polyacrylamide, Poly(ethylene-co-vinyl acetate), Poly(ethylene glycol), Poly(propylene glycol), Poly(methacrylic acid); etc.

The term "rubber" as used in relation to either rubber particles or rubber coated particles means any resilient elastomeric material, including natural and artificial rubbers, elastomers, and polymers such as thermoplastic polymers and elastomers and equivalent materials. Examples of elastomers include acryl rubber, butyl rubber, carboxylated acrylonitrile butadiene rubber (XNBR), carboxylated hydrogenated acrylonitrile butadiene rubber (XHNBR), EPDM/acrylonitrile graft copolymer, EPDM/styrene copolymer, epoxylated natural rubber, ethylene propylene (EPR), ethylene-propylene copolymers, ethylene-propylene-diene monomer (EPDM) rubber, ethylene-propylene-diene terpolymers, ethylenically unsaturated nitrile-conjugated diene-based high saturation copolymer rubber, fluoroelastomers (FKM), halogenated butyl rubber, hereinafter called EPDM, hereinafter called EPM, hydrin rubber, hydrogenated acrylonitrile butadiene rubber (HNBR), hydrogenated carboxylated acrylonitrile butadiene rubber (HXNBR), maleated BIMS copolymer, maleated ethylene-acrylic acid copolymer, maleated ethylene-butene rubber, maleated ethylene-decene rubber, maleated ethylene-ethyl acrylate copolymer, maleated ethylene-hexene rubber, maleated ethylene-methyl acrylate copolymer, maleated ethylene-octene rubber, maleated ethylene-propylene copolymer rubber, maleated ethylene-vinyl acetate copolymer, maleated halogenated isobutylene-isoprene copolymer, maleated isobutylene-isoprene copolymer, maleated isobutylene-paramethylstyrene copolymer, maleated star branched butyl (SBB) copolymer, maleic acid modified EPDM/acrylonitrile graft copolymer, maleic acid modified EPDM/styrene copolymer, maleic anhydride grafted acrylonitrile-butadiene-styrene rubber, maleic anhydride grafted ethylene-propylene-diene rubber, maleic anhydride grafted styrene-ethylene/butadiene-styrene rubber, natural rubbers, nitrile acrylonitrile butadiene rubber (NBR), nitrile butadiene rubber, nitrile rubber, perfluoroelastomers (FEKM), polyetheresters, polyethylene or polypropylene homo- or copolymers and polyisobutylene, polyisoprene, polymers comprising a thermoplastic and an elastomer, polyurethanes, reactive phenoxy thermoplastic resins, styrene-butadiene rubber (SBR), styrene/maleic acid copolymer, tetrafluoroethylene and propylene monomer (FEPM) elastomers as well as copolymers and mixtures thereof.

The term "sand" refers to a naturally occurring granular material composed of finely divided rock and mineral particles. Sand, for use as a component of the infill, is defined as one or more of the following: silica sand, silica quartz sand, rounded silica quartz sand, rounded washed silica quartz sand, and rounded washed, graded silica quartz sand and zeolite. In one embodiment the sand particles a have a diameter within the range of from about 0.0625 mm (or 1/16 mm) to about 2.0 mm. Optionally, the sand a can be colored. In some embodiments, the sand for the infill may comprise an acrylic or other polymer-coated sand.

The term "superabsorbent materials" refers to water-swellable, water-insoluble organic or inorganic materials including superabsorbent polymers and superabsorbent polymer compositions capable, under the most favorable conditions, of absorbing at least about 1 times their weight, or at least about 5 times their weight, or at least about 10 times their weight in an aqueous solution. Superabsorbent materials include a "superabsorbent polymer" or "SAP", a normally water-soluble polymer which has been cross-linked to render it substantially water insoluble, but capable of absorbing water. Numerous examples of superabsorbers and their methods of preparation may be found for example in U.S. Pat. Nos. 4,102,340; 4,467,012; 4,950,264; 5,147,343; 5,328,935; 5,338,766; 5,372,766; 5,849,816; 5,859,077; and U.S. Pat. Re. 32, 649. The super absorbent polymers may be, for example, polymers or copolymers of partially neutralized acrylic acid, acrylamide, or acrylic esters as copolymer only. Preferably, the super absorbent polymer may swell in water or other introduced liquids up to about 200 to about 400 times its size. It is also preferred that the super absorbent polymers are nontoxic. SAPs generally fall into three classes, namely starch graft copolymers, cross-linked carboxymethylcellulose derivatives and modified hydrophilic polyacrylates. Non-limiting examples of such absorbent polymers are hydrolyzed starch-acrylate graft co-polymer, saponified acrylic acid ester-vinyl copolymer, neutralized cross-linked polyacrylic acid, cross-linked polyacrylate salt, and carboxylated cellulose. The preferred SAPs, upon absorbing fluids, form hydrogels. SAPs are well known and are commercially available from several sources.

As used herein the terms "synthetic turf" or "artificial turf" or "artificial grass" can be issued interchangeably and include any form of artificial grass or turf conventionally used, for example, in athletic playing surfaces such as football, baseball, and soccer fields, and in other applications where an alternative to natural grass is desired. These applications include at least playgrounds, residential and commercial lawns, and other landscaping, jogging paths, paintball fields, tennis courts, putting greens, dog runs, landfill covers, medians and other areas near roadways, and airport grounds near runways. As described in detail in the U.S. Pat. No. 9,011,740, the entire disclosure of which is incorporated herein by reference, conventional synthetic turf typically includes a pile fabric having a backing and a plurality of upstanding ribbons, also called face fibers or filiform formations, resembling blades of grass. Typically, the upstanding ribbons are made of polyethylene, polypropylene, or a blend thereof. The ribbons may also be made of nylon or any other material known in the art alone or in combination with polypropylene and/or polyethylene. These face fibers are tufted or sewn into a primary backing material, which can be made of a number of different materials including, but not limited to, polypropylene and polyester. An adhesive coating material, or precoat, is commonly applied to the fiber and primary backing to hold the face fibers in place. In some embodiments, the primary coating of synthetic turfs includes polyurethane and also typically includes a filler such as calcium carbonate or coal fly ash. The primary coatings may also include latex, hot melt adhesives, and/or thermoplastics in addition to or instead of polyurethane. Synthetic turfs may also have a secondary coating, which may be similar to the primary coating described herein. Synthetic turfs may also have a secondary backing, which can be made of a number of different materials including, but not limited to, polypropylene and polyester. Synthetic turfs can be manufactured in the form of roll goods or, alternatively, can be manufactured in the form of tiles or panels of any desired length and width dimension.

"Water-absorbing material" as used herein includes, but is not limited to a hydrophilic polymer. "Water-absorbing material" as used herein includes, but is not limited to a highly absorbent material, which may comprise a superabsorbent polymer. Examples of water-vapor trapping materials include, but are not limited to, acrylate polymers, generally formed from acrylic acid, methacrylic acid, acrylate, methyl acrylate, ethyl acrylate, methyl methacrylate, ethyl methacrylate, a dialkylaminoalkyl acrylate, a dialkylaminoalkyl methacrylate, a trialkylammonioalkyl acrylate, and/or a trialkylammonioalkyl methacrylate, and include the polymers or copolymers of acrylic acid, methacrylic acid, methyl methacrylate, ethyl methacrylate, 2-dimethylaminoethyl methacrylate, and trimethylammonioethyl methacrylate chloride. Examples of hydrophilic polymers include, but is not limited to poly(N-vinyl lactams), poly(N-vinyl acrylamides), poly(N-alkylacrylamides), substituted and unsubstituted acrylic and methacrylic acid polymers, polyvinyl alcohol (PVA), polyvinylamine, copolymers thereof and copolymers with other types of hydrophilic monomers (e.g. vinyl acetate), polysaccharides, cross-linked acrylate polymers and copolymers, carbomers, cross-linked acrylamide-sodium acrylate copolymers, gelatin, vegetable polysaccharides, such as alginates, pectins, carrageenans, or xanthan, starch and starch derivatives, galactomannan and galactomannan derivatives. polyvinyl pyrrolidone (PVP), poly(N-vinyl caprolactam) (PVCap), poly(N-vinyl acetamides), polyacrylic acid, polymethacrylic acid, and copolymers and blends thereof. PVP and PVCap. Examples of superabsorbent polymers include hydrogels. Copolymers of any of the water-vapor trapping materials mentioned herein, and blends thereof may also be used.

As used herein, the term "surface-treatment agent" or "surface-modifying agent" refers to chemical agents that have the ability to modify, alter or react with the surface of a substrate by forming chemical bonds on the surface of the substrate. Specific non-limiting classes of surface treatment agents include surface-active agents, which include surfactants, detergents, wetting agents, and emulsifiers. Surface-active agents may be nonionic, anionic, cationic, amphoterics, hydrophobic or hydrophilic.

"Substrate" or "foundation" as used herein, refers to any surface upon which it is desirable to deposit a synthetic PIP surfacing system. In the present invention, the substrate is generally made up of fine granules of stone, gravel, sand, asphalt, cement, ceramic beads, soil, clay, diatomaceous earth, perlite, silica, organic minerals, rubber, or combinations thereof.

The term "% by weight" or "% wt." when used herein and referring to components of the composition, is to be interpreted as based on the weight of the composition, unless otherwise specified herein.

These terms may be defined with additional language in the remaining portions of the specification.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 2:
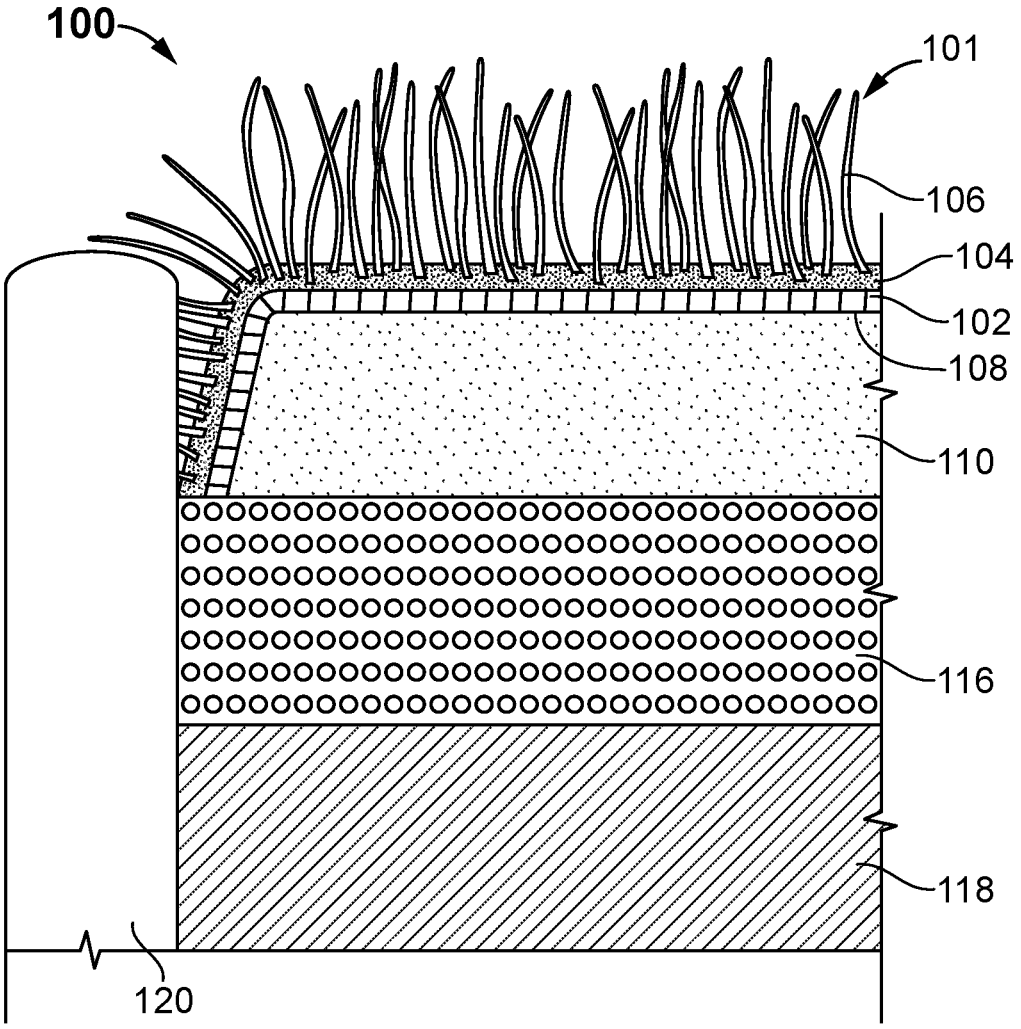
FIG. 2 shows a synthetic turf system installed next to the curb in one embodiment of the present invention.

Referring to FIGS. 1-2, a synthetic turf system (hereinafter referred as system) 100 is illustrated. The system 100 is a unique solution that has been designed to deliver improved athletic sports performance and player protection. In one embodiment, the system 100 has no infill system, which eliminates the usage of shock pads and crumb rubber infill.

Referring to FIG. 1, the system 100 installed next to the grass 112 is illustrated. The system 100 comprises a synthetic turf assembly 101 having backing layer 102 and a synthetic turf made up of a plurality of synthetic turf strands 106. In one embodiment, the system 100 further comprises a poured-in-place (PIP) rubber subsurface 110. The PIP rubber subsurface 110 is secured to the backing layer 102. In one embodiment, the PIP rubber subsurface 110 is secured to the backing layer 102 using a glue, binder, or adhesive layer 108. In one embodiment, the system 100 further comprises a particulate infill 104.

Synthetic Turf

Typically, the synthetic grass blades 106 are about 50-100 mm in length, although any length can be used. The blades 106 of artificial grass are securely placed, woven, or tufted onto the backing 102. One form of blades that can be used is a relatively wide polymer film that is slit or fibrillated into several thinner film blades after the wide film is tufted onto the backing 102. In another form, the blades 106 are relatively thin polymer films (monofilament) that look like individual grass blades without being fibrillated. Both of these can be colored to look like blades of grass and are attached to the backing 102.

The backing layer 102 of the artificial turf assembly 101 is typically water-porous by itself, but is often optionally coated with a water-impervious coating, such as for example polyurethane, to secure the turf fibers to the backing. In order to allow water to drain vertically through the backing 102, the backing can be provided with spaced apart holes. In an alternative arrangement, the water impervious coating is either partially applied, or is applied fully and then scraped off in some portions, such as drain portion, to allow water to drain through the backing layer 102. The blades 106 of grass fibers are typically tufted onto the backing 102 in rows that have a regular spacing, such as rows that are spaced about 4 millimeters to about 20 millimeters apart, for example. The incorporation of the grass fibers 106 into the backing layer 102 sometimes results in a series of spaced apart, substantially parallel, urethane coated corrugations or ridges on the bottom surface of the backing layer 102 formed by the grass blade tufts. Ridges can be present even where the fibers are not exposed.

In certain embodiments, the artificial turf can comprise a polyolefin, polyamide, polystyrene, polyurethane, polyester, polyvinyl chloride, polyacrylic, or any combination thereof. In certain embodiments, the artificial turf material comprises a polyolefin. In still further embodiments, the polyolefin comprises a polyethylene, polypropylene, or a combination thereof. In still further embodiments, the artificial turf comprises a polyamide. In some embodiments, the polyamide comprises nylon 6, nylon 6,6, nylon 1,6, nylon 12, nylon 6,12, or a combination thereof. In still further embodiments, the artificial turf comprises a polyester. In such embodiments, the polyester comprises polyethylene terephthlate, polypropylene terephthalate, polybutylene terephthlate, or any combination thereof.

The synthetic turf strands 106 may include any material that is conventionally used in carpet manufacture, singly or in combination with other such materials. For example, the synthetic turf strands 106 can be synthetic, such as, for example a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polybutylene terephthalate (PBT), polytrimethylene terephthalate (PTT), latex, styrene butadiene rubber, or any combination thereof. It is contemplated that the conventional nylon of the synthetic turf strands 106 can be, for example and without limitation, nylon 6/6, nylon 6, nylon 10, nylon 10/10, nylon 10/11, nylon 11, and the like. Additionally, the synthetic turf strands 106 can comprise natural fibers, such as cotton, wool, or jute. In exemplary embodiments, the synthetic turf strands 106 can comprise one or more biodegradable materials, including, for example and without limitation, polylactic acid (PLA).

The primary backing layer 102 may include any material that is conventionally used in carpet manufacture, singly or in combination with other such materials. For example, the primary backing layer 102 can be synthetic, such as, for example a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polytrimethyleneterephthalate (PTT), polybutylene terephthlate (PBT), latex, styrene butadiene rubber, or any combination thereof. It is contemplated that the conventional nylon of the primary backing layer 102 can be, for example and without limitation, nylon 6/6, nylon 6, nylon 10, nylon 10/10, nylon 10/11, nylon 11, and the like. Additionally, the primary backing layer 102 can comprise natural fibers, such as cotton, wool, or jute. In exemplary embodiments, the primary backing layer 102 can comprise one or more biodegradable materials, including, for example and without limitation, polylactic acid (PLA).

The adhesive layer 108 can include polyurethane, latex, hot melt adhesive, and/or thermoplastics alone or in combination. Suitable hot melt adhesives include, but are not limited to, Reynolds 54-041, Reynolds 54-854, DHM 4124 (The Reynolds Company P.O. Greenville, S.C., DHM Adhesives, Inc. Calhoun, Ga.). Suitable thermoplastics include, but are not limited to polypropylene, polyethylene and polyester. The adhesive layer 108 can also include a filler such as coal fly ash, calcium carbonate, iron oxide, or barium sulfate, or any other filler known in the art. The adhesive layer 108 can include from about 0 wt. % to about 100 wt. % polyurethane, from about 0 wt. % to about 100 wt. % latex, from about 0 wt. % to about 100 wt. % hot melt adhesive, and/or from about 0 wt. % to about 100 wt. % thermoplastic.

Infill

Synthetic turf may also include an infill material dispersed among the upstanding ribbons, which acts as a ballast and/or contributes to the physical properties of the turf, such as resiliency, that make the turf suitable for a particular use. Synthetic turf infill may be made of any material suitable for providing desired physical properties for the synthetic turf, but most often includes materials such as sand, gravel, cork, polymer beads, dirt, natural soils, or a combination thereof. As a disclosed above, infill material can be applied at the site of the turf field being constructed. The application of the infill mixture or individual components onto the turf can be by a drop spreader or a broadcast spreader, or by any other suitable mechanism.

In one embodiment the amount of sand applied with the infill constitutes about 3 to about 10 pounds per square foot. In other embodiments the amount of sand is within the range of from about 4 to about 9 pounds per square foot. In another embodiment, the amount of sand is about 5 to about 8 pounds per square foot. In another embodiment, the amount of sand is about 6 to about 7 pounds per square foot. In one embodiment, the infill material includes sand in an amount within the range of from about 70 to about 100 percent by dry bulk weight, and other materials in an amount within the range of from about 0 to about 30 percent by dry bulk weight. In one or more embodiments, the synthetic turf infill comprises at least 75, 80, 85, 90, 95 wt. % or more of sand. In one or more embodiments, the synthetic turf infill comprises less than about 30, 25, 20, 15, 10, 5, 2 wt. % or less of rubber materials including but not limited to crumb rubber, ethylene propylene diene monomer (EPDM) rubber, and neoprene rubber.

One commonly employed reference standard for the construction of a high-performance sports turf rootzone is the ASTM F2396, "Standard Guide for Construction of High-Performance Sand-Based Rootzones for Athletic Fields". This specification describes a natural turf root zone that consists of approximately 95% graded sands and approximately 5% organic materials (e.g. peat) by weight. Another commonly employed standard for the construction of a high-performance sports turf rootzone is the USGA Specification to Guide the Construction of Sand Root Zones. This specification describes a natural turf root zone that consists of at least about 90% graded sands and no more than about 10% organic material by weight.

The infill may be subject to settling, separation, and segregation over time. Several strategies can be used to prevent or retard separation or segregations. In some embodiments, various additives, such as starch or adhesives, or cohesion-enhancing coatings or substances, or polymer emulsions, are used to cause the infill particles to stick together and to prevent or retard the particles in the infill from segregating by size during storage, transportation, and application to the turf field, and also during use of the turf field after installation. Ideally, the infill particles have an affinity for each other, both physically and chemically. Physically, the particles may form a network, randomly orienting the length L of particles in various directions. Chemically, the particles have an attraction as a result of weak particle-to-particle hydrogen bonds.

One mechanism that can be used to prevent segregation by size, and to prevent over compaction is to use different shaped particles, i.e., with some of the infill particles having one shape or set of shapes, and other infill particles having other shapes. Other mechanisms to prevent over compaction can be used. Also, having a particle size distribution of infill particles will improve rotational resistance of athletes' shoe cleats. It is desirable to provide infill that acts like a thatch zone in natural turf for shoe cleat rotation. In one embodiment a top-dressing layer, different from the underlying infill mixture, is applied as a top infill layer during construction of the turf system.

Conventional turf systems using a sand/ground rubber infill mixture tend to absorb heat, and such systems often experience uncomfortably hot turf surface temperatures during hot, sunny weather. The field can be cooled off by applying water to the field. Ideally, the turf field is designed to release its moisture slowly so that the cooling effect will occur over a longer period of time. An additive, such as a wetting agent can be incorporated into the infill mixture. Other examples include using vermiculate, pearlite (also known as perlite), and Zeolite, as well as other organic and inorganic absorbents including montmorillonite clay and Bentonite. These materials act as a water reservoir by absorbing moisture. In one embodiment, the additive will make the infill mixture more hydrophilic. Superabsorbent materials, including superabsorbent polymer (SAP) compounds, can be used to release moisture over time and keep surface temperatures lower are a possible solution for reducing surface temperatures on synthetic turf. The SAP compounds may be used to coat the infill particles and/or SAP particles can be added as part of the infill. The presence of the water absorbent polymer helps to moderate field temperature and makes aeration more effective. This increases the playability and lifetime of the field.

Poured-In-Place (PIP) Rubber Subsurface

In one or more embodiments, the poured-in-place (PIP) rubber subsurface 110 is a composite using ground rubber (buffings) and one or more binders. In one embodiment, the binder may be polyurethane binder or aromatic polyurethane binder.

In one or more embodiments, the buffings component may generally be made up of elongated, i.e. fiber-like, predominantly styrene butadiene rubber (SBR) strands. In some embodiments, the strands may have a thickness between about 0.5 mm and about 2.0 mm and a length between about 3.0 mm and about 20.0 mm. The strands may generally have an aspect ratio (length to width) of at least 2, alternatively at least 3, alternatively at least 5, alternatively at least 7.

In one or more embodiments, the poured-in-place (PIP) rubber subsurface 110 is formed from a rubber-containing mixture, which is poured onto a substrate. The rubber-containing mixture includes rubber particles and one or more binders which will bind the rubber. The rubber particles and binder(s) are placed into a mixer, which would likely be situated at or proximate the prepared site at which the mat is to be formed. The rubber particles may be fine rubber crumbs, small rubber chunks, rubber slivers/buffing and combinations thereof. Further, the rubber particles may be recycled rubber particles, e.g., from used tires or other rubber products such as shredded recycled tires.

The binders may each be any binder known to those skilled in the art which interacts with rubber particles and binds the rubber particles into a cohesive unit, e.g., when the binder is exposed to air for a certain amount of time. An example of a common binder used in this field is polyurethane. Two other types of common binders are SBR and acrylic binders. SBR binders are often used to increase sealing performance with oils. SBR binders generally will cause a material to swell or expand when in contact with oils. This property provides increased sealing performance by allowing the material to seal potential leak paths in an application. SBR materials offer better sealing performance with less-than-ideal sealing flange surfaces, or between dissimilar sealing surfaces, such as a stamped-pan sealing against a cast surface area.

Some techniques to mix rubber particles and a binder are disclosed in U.S. Pat. No. 6,896,964, the entire disclosure of which is incorporated herein by reference above. A binder as used herein will also include any suitable liquid or polymeric liquid precursor that subsequently can form a polymer upon exposure to moisture in the air.

After the mixture is prepared and while still in its liquid form, it is placed over the substrate. For example, the mixture can be transported from mixer to the defined area. The fluid mixture may be prevented from flowing outside of the area by appropriate shaping and working. The mixture is then allowed to dry (cure).

In the polyurethane binder process, a mixture of ground rubber (crumb rubber) and one or more polyurethane binders is molded or formed and cured. The binder may be cured in a "hot-cure" process, at elevated temperatures, or in a "cold-cure" process, at ambient temperature and at ambient or low pressures. Cold-cure processes are typically used when the mixture is cured on-site In one embodiment, the binder may be polyurethane binder or aromatic polyurethane binder. The polyurethane binder has various properties at specific test conditions. For example, at 68° F., the polyurethane binder has specific gravity of about 1.09 g/cm 3, density of about 9.10 lbs/gal, and viscosity of about 4200 mPa s. During application, a ratio of about 18-22 parts binder to 100 parts of rubber (18-22%) is used for top surfaces. In another embodiment, about wt. % binder is used for base layers. In one embodiment, about 10-30 wt. % binder is used for base layers. In another embodiment, about 12-20 wt. % binder is used for base layers. In another embodiment, about 14-18 wt. % binder is used for base layers. In another embodiment, at least about 10, 11, 12, 13, 14, 15, 16, 17, 18 wt. % or more of binder is used for base layers.

In one embodiment, the PIP rubber subsurface 110 is substantially free of crumb rubber infill and shock pads. In one embodiment, the PIP rubber subsurface 110 is treated with polyurethane. In one embodiment, the PIP rubber subsurface 110 is poured with a mixture of rubber buffing and urethane configured to deliver improved safety, playability, and reduced maintenance requirements for the synthetic turf 101 that is placed on a playing surface. In one embodiment, the mixture utilizes 8 to 32 pounds of urethane per 100 pounds of rubber buffing. In one embodiment, the synthetic turf 101 is attached to the PIP rubber subsurface 110 by free floating. In another embodiment, the synthetic turf 101 is attached to the PIP rubber subsurface 110 using a full-spread adhesive. In another embodiment, the synthetic turf 101 is attached to the PIP rubber subsurface 110 using a partial-spread adhesive. In another embodiment, the synthetic turf 101 is attached to the PIP rubber subsurface 110 using a rolled edge. In another embodiment, the synthetic turf 101 is attached to the PIP rubber subsurface 110 using a tucked edge.

In one embodiment, the PIP rubber subsurface 110 is formed from a rubber-containing mixture of rubber buffings and rubber granules (crumb rubber), in particular ethylene propylene diene monomer (EPDM) rubber granules or styrene-butadiene rubber (SBR) granules.

In one embodiment, the PIP rubber subsurface 110 is formed from a rubber-containing mixture of 10:90, 20:80, 30:70; 40:60: 50:50, 60:40, 70:30, 80:20, 90:10 rubber buffings to rubber granules ratio. In another embodiment, the PIP rubber subsurface 110 is adjusted in thickness to vary the HIC and ball speed of the playing field. For example, a 4" thick subsurface having a 50:50 rubber buffings to rubber granules ratio allows more consistent and more accurate play as compared to a natural surface.

In another embodiment, at least 1, 2, 3, 4, 5, 6, 7, 8, 9, 10, 11, 12, 13, 14, 15, 16, 17, 18, 19, 20% or more of the volume of the compacted the PIP rubber subsurface 110 consists of air-filled cavities. In another embodiment, at least 5%, preferably at least 10%, e.g., at least 20%, preferably 5-35%, of the volume of the compacted the PIP rubber subsurface 110 consists of air-filled cavities.

In one embodiment, the system 100 further comprises a plurality of cooling particle infill 104 to avoid dislodging of infill into athlete's shoes, clothes, eyes, or ears. In one embodiment, the infill may be an anti-microbial infill.

In one embodiment, the synthetic turf 101 has a dimension of about 0.5" to 3.5" pile or synthetic turf strand height per specification. In one embodiment, the PIP rubber subsurface 110 is poured with a mixture of rubber buffing and urethane configured to deliver improved safety, playability, and reduced maintenance requirements for the synthetic turf 101 placed on the playing surface. The PIP rubber subsurface 110 is poured or troweled on the ground structure or site.

In one embodiment, the synthetic turf system 100 includes a consistent head injury criterion (HIC) rating (i.e., the HIC remains constant all the time, even throughout the competition). Fully bonded HIC allows for consistent concussion resistance from 2' to 10' depending on design specifications. In one embodiment, the synthetic turf system 100 is about 30 to 50 degrees cooler than the traditional turf systems while having no exposed ethylene propylene diene monomer (EPDM). In one embodiment, the cooling particle infill 104 has anti-microbial properties. In one embodiment, the system 100 further maintains consistent concussion resistance throughout the entire playing surface.

In one embodiment, the PIP rubber subsurface 110 comprises rubber buffings with a dimension of about 0.187" (for 4 mesh), 0.0787" (for 10 mesh), and 0.473" (for 16 mesh).

In another embodiment, the PIP rubber subsurface 110 comprises rubber buffings with a dimension of about 2-20 mesh or 4-16 mesh. In one embodiment, the thickness of the PIP rubber subsurface 110 is customized to meet GMAX and fall height requirements. In one embodiment, the PIP rubber subsurface 110 is the key component for delivering performance, playability, and safety for the athletes while greatly decreasing the amount of maintenance required. In one embodiment, the material itself provides buoyancy and the voids in the impact course range between 0.1 and 0.4 inches.

In one embodiment, the synthetic turf 101 is installed next to the grass 112. In one embodiment, the synthetic turf 101 is installed or glued to a horizontal and sloped buffing area or PIP rubber subsurface (i.e., cushion) 110 above the ground structure. In one embodiment, the PIP rubber subsurface 110 is about 1.5" to 4" in thickness.

The type of surface use determines the required PIP rubber subsurface thickness, and the PIP rubber subsurface thickness may be different for various uses. Depending on ASTM F1292 requirements for critical fall height (4', 5', 6', 7', 8', 9', 10', 12' or 13' (1219, 1524, 1829, 2134, 2438, 2743, 3048, 3657 or 3962 mm), the PIP rubber subsurface thickness may be 1¼ ", 2", 2½", 2½", 3", 3½", 4", 4½", 5" 6" or more (32, 51, 63, 63, 76, 89, 102, 114, 127 152 mm, or more).

In one embodiment, the synthetic turf system 100 further comprises a first sub-layer 116 underneath the PIP rubber subsurface 110 configured to allow water to pass through easily. In one embodiment, the first sub-layer 116 is compacted gravel layer. In one embodiment, the synthetic turf 101 extends down the slope of the PIP rubber subsurface 110 and the first sub-layer 116. In one embodiment, the first sub-layer 116 may include the compacted gravel of about 4" deep above the ground structure. In one embodiment, a dirt backfill 114 holds the synthetic turf 101 to the PIP rubber subsurface 110. The synthetic turf 101 is at the same finished grade (or slightly higher) than natural grass. Depending on requirements, the first sub-layer thickness may be 1¼ ", 2", 2½", 2½", 3", 3½", 4", 4½", 5" 6" or more.

In one embodiment, the system 100 further comprises a second sub-layer 118 underneath the first sub-layer 116. The second sub-layer 118 is sub-grade water drainage to drain the water as needed. In one embodiment, the drainage percolates water at 5 gallons per minute per square foot. In one embodiment, the system 100 maintains maximum of about 1% moisture and approximately about 27-28 lbs/ft$^2$. In still further embodiments, the poured-in-place (PIP) rubber subsurface 110 disclosed herein can exhibit beneficial drainage characteristics. This drainage can be in a vertical direction, a lateral or horizontal direction, or a combination of both. In some embodiments, either the face or back surface can be profiled to provide pathways for drainage.

In yet other embodiments, a plurality of channels can be configured in either the face or back surface extending laterally along a surface to provide enhanced lateral or horizontal drainage. Still further, a separation layer can be present as noted above. This too can enhance lateral drainage toward the edges of the poured-in-place (PIP) rubber subsurface 110 rather than draining through the subsurface from one face to another. The horizontal drainage can be used to define a hydraulic transmissivity of the disclosed pads.

In certain embodiments, the disclosed poured-in-place (PIP) rubber subsurface 110 can provide a free-flowing vertical drainage system. The drainage can be measured according to ASTM D3385 standard. In some embodiments, the vertical drainage can accommodate up from about 10 in/h to about 7,000 in/h of fluid flow, including exemplary values of about 50 in/h, about 100 in/h, about 500 in/h, about 1,000 in/h, about 2,000 in/h, about 3,000 in/h, about 4,000 in/h, about 5,000 in/h, and about 6,000 in/h. In yet other embodiments, the vertical drainage can accommodate any water flow between the two foregoing values. The vertical drainage can be used to define the permeability of the disclosed poured-in-place (PIP) rubber sub surface 110.

Referring to FIG. 2, the system 100 installed next to a curb 120 is illustrated. In one embodiment, the system 100 is installed against the curb 120 or tucked against the curb 120 at least on any one end. The system 100 comprises a backing layer 102 and a synthetic turf 101 having a plurality of synthetic turf strands 106. In one embodiment, the system 100 further comprises a poured-in-place (PIP) rubber subsurface 110. The PIP rubber subsurface 110 is secured to the backing layer 102. In one embodiment, the PIP rubber subsurface 110 is secured to the backing layer 102 using a glue or binder or adhesive layer 108. In one embodiment, the PIP rubber subsurface 110 is substantially free of crumb rubber infill and shock pads.

In one embodiment, the PIP rubber subsurface 110 is treated with polyurethane. In one embodiment, the PIP rubber subsurface 110 is poured with a mixture of rubber buffing and urethane configured to deliver improved safety, playability, and reduced maintenance requirements for the synthetic turf 101 that is placed on a playing surface. In one embodiment, the mixture utilizes 8 to 32 pounds of urethane per 100 pounds of rubber buffing. In one embodiment, the synthetic turf 101 is attached to the PIP rubber subsurface 110 by free floating. In another embodiment, the synthetic turf 101 is attached to the PIP rubber subsurface 110 using a full-spread adhesive. In another embodiment, the synthetic turf 101 is attached to the PIP rubber subsurface 110 using a partial-spread adhesive. In another embodiment, the synthetic turf 101 is attached to the PIP rubber subsurface 110 using a rolled edge. In another embodiment, the synthetic turf 101 is attached to the PIP rubber subsurface 110 using a tucked edge.

In one embodiment, the system 100 further comprises a plurality of cooling particle infill 104 to retain moisture and to avoid dislodging of infill into athlete's shoes, clothes, eyes, or ears. In one embodiment, the infill may include an anti-microbial infill.

In one embodiment, the synthetic turf 101 is glued to the horizontal and vertical ends of PIP rubber subsurface 110. In one embodiment, the PIP rubber subsurface 110 has a dimension of about is about 1.5"-4". In one embodiment, the synthetic turf 101 is glued to the curb 120 at least 3" in depth. In one embodiment, the system comprises a first sub-layer 110. The first sub-layer 110 is compacted gravel having a dimension of about 4" deep. In one embodiment, the system 100 further comprises a second sub-layer 118 underneath the first sub-layer 116. The second sub-layer 118 is sub-grade water drainage to drain the water as needed.

Advantageously, the system of the present invention improves the safety, playability, and reduces maintenance requirements. The maintenance costs throughout the life cycle of the field reduced by 75%. The system reduces a surface temperature to reduce heat stroke. Also, the system requires no crumb rubber infill or rubber nugget infill. Further, the replacement cost of the system is about half of a traditional field. In addition, the system includes a low slip easy grip with turf cleats and the ball speed can be adjusted to the primary sport and the system has better concussion properties. Further, the HIC layer is 100% recycled, and may remain for 3 to 4 life cycles of the playing surface.

To define the area, the underlying ground surface may be worked as known to those skilled in the art. Alternatively, the ground surface does not have to be worked and may be left as is, e.g., ungraded, because the foundation, such as loose fill material, will naturally fill in any voids or depressions in the ground surface. The loose fill material constitutes a base layer and may include any material or combination of materials that meets the ASTM 1292 standard for impact attenuation. Examples of such materials include rubber mulch, wood chips, shredded tire rubber, pea gravel and loose foam. In a preferred embodiment, the loose fill material would include only recycled rubber particles without any binder.

The poured in place (PIP) surfacing may further comprise an underground sprinkler system for applying water to the super absorbent polymers as needed, one or more thermal probes for determining the temperature of the synthetic tuft systems, or a combination thereof The one or more thermal probes may be a thermocouple system in substantial contact with the poured in place (PIP) synthetic surfacing and would allow remote monitoring of the installation.

In one embodiment with poured in place (PIP) synthetic surfacing, an impact layer base is first prepared using a rubber-containing mixture. The rubber-containing mixture includes rubber particles and one or more binders which will bind the rubber. The rubber particles and binder(s) are placed into a mixer, which would likely be situated at or proximate the prepared site at which the surfacing is to be formed. The mixer may be similar to a portable cement mixer. Although rubber particles are preferred, any shock-absorbing material may be used in the invention. The rubber particles preferably have a granule size from about 0.5 mm to about 4 mm and/or may be thermoplastic vulcanized (TPV) granules. However larger or smaller sizes are acceptable. The rubber particles may be fine rubber crumbs, small rubber chunks, rubber slivers/buffing and combinations thereof. Further, the rubber particles may be recycled rubber particles, e.g., from used tires or other rubber products such as shredded recycled tires.

Additives

In one embodiment, the odor absorbing/inhibiting active inhibits the formation of odors. An illustrative material is a water-soluble metal salt such as silver, copper, zinc, iron, and aluminum salts and mixtures thereof. In another embodiment, the metallic salts are zinc chloride, zinc gluconate, zinc lactate, zinc maleate, zinc salicylate, zinc sulfate, zinc ricinoleate, copper chloride, copper gluconate, and mixtures thereof. In another embodiment, the odor control actives include nanoparticles that may be composed of many different materials such as carbon, metals, metal halides or oxides, or other materials. Additional types of odor absorbing/inhibiting actives include cyclodextrin, zeolites, silicas, activated carbon (also known as activated charcoal), acidic, salt-forming materials, and mixtures thereof. Activated alumina ($Al_2O_3$) has been found to provide odor control comparable and even superior to other odor control additives such as activated carbon, zeolites, and silica gel. Alumina is a white granular material and is also called aluminum oxide.

In some embodiments, additional additives may optionally be employed with the particulate superabsorbent polymer compositions, including odor-binding substances, such as cyclodextrins, zeolites, inorganic or organic salts, and similar materials; anti-caking additives, flow modification agents, surfactants, viscosity modifiers, and the like. In addition, additives may be employed that perform several roles during modifications. For example, a single additive may be a surfactant, viscosity modifier, and may react to cross-link polymer chains.

In another embodiment, a color altering agent such as a dye, pigmented polymer, metallic paint, bleach, lightener, etc. may be added to vary the color of absorbent particles, such as to darken or lighten the color of all or parts of the composition so it is more appealing. In another embodiment, the color-altering agent comprises up to approximately 20% of the absorbent composition, more preferably, 0.001%-5% of the composition. In another embodiment, the color altering agent comprises approximately 0.01%-1% of the composition. In another embodiment, the carriers for the color-altering agent are zeolites, carbon, charcoal, etc. These substrates can be dyed, painted, coated with powdered colorant, etc.

Selection of the site may be a determination of a site for a playground, running track, athletic field, sports area, activity space, walking path, etc. Preparation of the site may include defining an area in which the surfacing is to be formed and then placing substrate or loose fill material into the defined area. To define the area, the underlying ground surface may be worked as known to those skilled in the art. Alternatively, the ground surface does not have to be worked and may be left as is, e.g., ungraded, because the loose fill material will naturally fill in any voids or depressions in the ground surface.

The loose fill material constitutes a base layer and may include any material or combination of materials that meets the ASTM 1292 standard for impact attenuation. Examples of such materials include rubber mulch, wood chips, shredded tire rubber, pea gravel and loose foam. In a preferred embodiment, the loose fill material would include only recycled rubber particles without any binder.

The rubber particles may be fine rubber crumbs, small rubber chunks, rubber slivers/buffing and combinations thereof. Further, the rubber particles may be recycled rubber particles, e.g., from used tires or other rubber products such as shredded recycled tires.

Rubber particles include granular material, which may be fabricated of a rubber material. In another embodiment, the granular material comprises SBR crumb rubber. In one embodiment, crumb rubber particles have a median size that is within a range of about 10 to about 80 mesh.

In one embodiment, the rubber particles are made from styrene-butadiene or styrene-butadiene rubber (SBR) families of synthetic rubbers derived from styrene and butadiene. These materials have good abrasion resistance and good aging stability when protected by additives. In one embodiment, the rubber particles are black recycled rubber in particle sizes of 0.5 mm-4 mm.

In another embodiment, the rubber particles are made from EPDM rubber (ethylene propylene diene monomer (M-class) rubber), a type of synthetic rubber. EPDM rubber is primarily used because of its resistance to extremes of temperature and its general toughness.

In another embodiment, the rubber particles are made from TPV (Thermoplastic Vulcanizate) rubber granules for same applications, such as EPDM rubber granules. TPV granules are highly color stable, elastic, long lasting materials that can be used in athletic track facilities. EPDM and TPV granules with sizes 0.5-1.5 mm can be used for spray coating applications for running tracks and our 0.5-5 mm granules are used for multipurpose sport floors and playground floors.

In one embodiment, a primer, which is used as an adhesive component between the sub-floor and the successive layers of surfacing such as recycled SBR with polyurethane binder and EPDM with polyurethane binder, is used. In one embodiment, the primer may be a clear, polyurethane-based, one-component resin.

Specific techniques to mix rubber particles and a binder are disclosed in U.S. Pat. No. 6,896,964, the entire disclosure of which is incorporated herein by reference above. A binder as used herein will also include any suitable liquid or polymeric liquid precursor that subsequently can form a polymer upon exposure to moisture in the air.

After the mixture is prepared and while still in its liquid form, it is placed over the substrate material. For example, the mixture can be transported by hand, pump, trough, spigot, wheelbarrow, or buckets from the portable mixer to the defined area. The fluid mixture may be prevented from flowing outside of the area by appropriate shaping and working. The mixture is then allowed to dry (cure).

If the mixture will provide the uppermost layer of the poured in place surfacing when dry, then the mixture is preferably smoothed after it has been placed into the defined area and before it dries. The mixture may be smoothed by workers using trowels or by any other smoothing means known to those skilled in the art.

In one embodiment, the surfacing comprises a variable depth multi-layer system. In one embodiment, the surface depth is from about 10 to about 200 mm. In one embodiment, the base layer can be from about 10 mm to 150 mm deep, depending on the specific application. In one embodiment, the top wear layer comprises a high-grade EPDM rubber granule mixture with a polymer resin binder in a depth of from about 5 to about 25 mm. In another embodiment, a polyurethane resin binder is used for both the SBR and EPDM granular layers.

While there are several different types of suitable sub-surfaces, one sub-surface for surfacing is properly placed and cured concrete or asphalt. In another embodiment, the surfacing can alternatively be installed over a properly graded, leveled, and compacted subbase of about 1-4 inches of aggregate of the correct size, type, and consistency, covered by a layer of properly leveled and compacted "chip dust" or "granite screenings" (¼-inch minus).

With the foregoing structure, a poured in place turf surfacing in accordance with the invention provides significant advantages over prior art poured in place surfacing. In one embodiment, the base layer includes loose fill material, which is not limited to rubber materials and may include only non-rubber materials, only loose rubber materials without a binder, only recycled material, or only recycled loose rubber materials without a binder. In other embodiments, the base layer is comprised exclusively of rubber granules that are contained in either a bagged system or are mixed with polyurethane binders that form them into a unitary structure.

Coatings

In some embodiments of the invention, the coating composition comprises a surfactant, and the concentration of the surfactant is less than about 5.0% and greater than about 0.001%. In yet another embodiment of the invention, the coating composition comprises a surfactant, and the concentration of the surfactant is selected from the group consisting of less than about 5%, less than about 4.5%, less than about 4.0%, less than about 3.5%, less than about 3.0%, less than about 2.5%, less than about 2.0%, or less than about 1.5%. Further, the concentration of the agent in the coating composition is greater than about greater than about 0.006%, greater than about 0.007%, greater than about 0.008%, greater than about 0.009%, greater than about 0.010%, or greater than about 0.01%. In one embodiment, the concentration of the agent in the coating composition is less than about 5.0% and greater than about 0.001%.

In one or more embodiments, the surfactants of the present invention are aqueous-based surfactants. By aqueous based it is meant that the surfactant comprises mainly water as the carrier medium for the remaining surfactant components. In a preferred embodiment, the surfactants of the present invention comprise at least about 50-weight percent water. Surfactant-based surfactants are defined as surfactants containing at least a dispersion of water-insoluble surfactant particles.

The surfactant compositions of the present invention contain low levels, relative to the colorant and polymer levels, of dispersions of metal oxides such as alumina and zinc oxide that have a negative zeta potential at a pH of greater than 4. These metal oxide dispersions may include a surface treatment or addenda such as a surfactant or polymer that provides a stable negative zeta potential to the particles over the pH range of interest. These metal oxide dispersions can be added to surfactant compositions containing negatively charged surfactants and polymers with no significant destabilizing interaction. Preferred levels of addition of such metal oxide particles are from 10 to 10,000 ppm, more preferably from 50 to 1000 ppm. While higher levels within such ranges are possible, generally levels below about 500 ppm are sufficient. It is beneficial that the particles are small enough so that they have a high surface area. The particle size preferably should be less than 100 nm, and more preferably less than or equal to about 50 nm.

Polyvalent metal oxide particles employed in the invention may contain aluminum or other polyvalent metal ions that can form metal oxide bonds. Aluminum ion in particular has been found to be effective to inhibit aqueous dissolution of silicon oxide-based glass. Other polyvalent metal ions such as zinc, zirconium, hafnium, and titanium may also be useful. The surfactants of the present invention preferably comprise surfactant particles dispersed in the aqueous carrier.

As noted, the surfactants of the invention may comprise self-dispersing surfactants that are dispersible without the use of a dispersant. Surfactants of this type are those that have been subjected to a surface treatment such as oxidation/reduction, acid/base treatment, or functionalization through coupling chemistry. The surface treatment can render the surface of the surfactant with anionic, cationic, or non-ionic groups, as described above.

The surfactant particles are preferably dispersed by a polymeric or small molecule dispersant in an amount sufficient to provide stability in the aqueous suspension and subsequent surfactant. The amount of dispersant relative to surfactant is a function of the desired particle size and related surface area of the fine particle dispersion. It is understood that the amount of dispersant and relative ratios of the monomer constituents of a polymeric dispersant can be varied to achieve the desired particle stability and surfactant firing performance for a given surfactant, as it is known that surfactants can vary in composition and affinity for a polymeric dispersant.

The surfactants used in the surfactant composition of the invention may be present in any effective amount, generally from 0.1 to 10% by weight, and preferably from 0.5 to 6% by weight, more preferably from 1 to 4% by weight.

In the composition according to the invention, the amount of surfactant compound is between 0.5 and 5% by weight based on the amount of the surface-treatment agent. The amount of the surface-treatment agent is preferably between 10 and 35% by weight of the final composition. The amount of water in the composition is generally between 5 and 90% by weight.

In a preferred embodiment of the process of the invention, the applied composition contains 2 to 10% by weight of the mixture of the active compounds. This composition is applied in the quantity of 0.05 to 4 liters/$m^2$.

Various techniques may be used for applying a coating solution to an infill particle such as casting, spinning, spraying, dipping (immersing), ink jet printing, electrostatic techniques, and combinations of these processes. Choosing an application technique principally depends on the viscosity and surface tension of the solution. In embodiments of the present invention, dipping and spraying are preferred because it makes it easier to control the uniformity of the coating layer.

The synthetic PIP surfacing materials system may further comprise an underground injection, watering, or sprinkler system for applying water to the surfacing as needed, one or more thermal probes for determining the temperature of the synthetic surfacing systems, or a combination thereof. The one or more thermal probes may be a thermocouple system in substantial contact with the synthetic PIP surfacing materials system and would allow remote monitoring of the installation.

The surfacing material may further be treated with one or more performance-enhancing additive such as antimicrobial agents, one or more anti-freezing agents, or a combination thereof.

As described herein, it is desirable to have a surface-modifying agent coating the rubber particles of synthetic PIP surfacing materials to provide a source of water for evaporative cooling of the turf surface during hot weather.

In another embodiment, the rubber particles are fabricated so that the surface-modifying agent coating comprises about 0.02% to about 10% by weight of core of granular material. In another embodiment, the surface-modifying agent coating comprises about 0.04% to about 5.0% by weight of the core of granular material. In another embodiment, the coating comprises about 0.06% to about 3.0% by weight of the core of granular material.

In one embodiment, performance-enhancing additive(s) are added to the material. In one embodiment, the performance-enhancing additive(s) are antimicrobials. In one embodiment, the antimicrobial actives are boron containing compounds such as borax pentahydrate, borax decahydrate, boric acid, polyborate, tetraboric acid, sodium metaborate, anhydrous, boron components of polymers, and mixtures thereof.

In one embodiment, the odor absorbing/inhibiting active inhibits the formation of odors. An illustrative material is a water-soluble metal salt such as silver, copper, zinc, iron, and aluminum salts and mixtures thereof. In another embodiment, the metallic salts are zinc chloride, zinc gluconate, zinc lactate, zinc maleate, zinc salicylate, zinc sulfate, zinc ricinoleate, copper chloride, copper gluconate, and mixtures thereof. In another embodiment, the odor control actives include nanoparticles that may be composed of many different materials such as carbon, metals, metal halides or oxides, or other materials. Additional types of odor absorbing/inhibiting actives include cyclodextrin, zeolites, silicas, activated carbon (also known as activated charcoal), acidic, salt-forming materials, and mixtures thereof. Activated alumina ($Al_2O_3$) has been found to provide odor control comparable and even superior to other odor control additives such as activated carbon, zeolites, and silica gel.

In some embodiments, additional additives may optionally be employed with the particulate compositions, including odor-binding substances, such as cyclodextrins, zeolites, inorganic or organic salts, and similar materials; anti-caking additives, flow modification agents, surfactants, viscosity modifiers, and the like. In addition, additives may be employed that perform several roles during modifications. For example, a single additive may be a surfactant, viscosity modifier, and may react to cross-link polymer chains.

In another embodiment, a color altering agent such as a dye, pigmented polymer, metallic paint, bleach, lightener, etc. may be added to vary the color of rubber particles, such as to darken or lighten the color of all or parts of the composition so it is more appealing. In another embodiment, the color-altering agent comprises up to approximately 20% of the infill composition, more preferably, 0.001%-5% of the composition. In another embodiment, the color altering agent comprises approximately 0.001%-0.1% of the composition.

In another embodiment, the carriers for the color-altering agent are zeolites, carbon, charcoal, etc. These substrates can be dyed, painted, coated with powdered colorant, etc.

In another embodiment of the invention, surfacing installed with surface-modifying agent coated rubber particles, which have lost effectiveness for cooling can also be reactivated by introducing additional surface-modifying agent solution. The surface-modifying agent solution can be introduced by spraying or by injecting the surface-modifying agent solution into the top layer of the surfacing.

In an alternative embodiment of the, the synthetic PIP surfacing materials system may further comprise surfacing, which may be comprised of one or more layers. When more than one layer comprises the surfacing, each layer of the surfacing may be of different compositions than other layers. It is understood that in some embodiments, the subsurface disclosed herein can be used as an underlayment for an indoor artificial turf. In still further embodiments, the subsurface disclosed herein can be used as an underlayment for an indoor artificial turf, an outdoor artificial turf, or a combination thereof. In yet other embodiments, the subsurface disclosed herein can be useful in construction of a soccer, baseball, hockey, lacrosse, gym floor, football, or a rugby field. It is understood that the subsurface disclosed herein are recyclable to produce third, or fourth generation products. In fact, it is further understood that the subsurface disclosed herein can undergo multiple recycle cycles.

It is understood that the subsurface 110 used in the artificial turf system 100 can be any subsurface disclosed herein. It is further understood that the artificial grass layer of the disclosed system can be any artificial grass layer known in the art and used in the industry. The artificial grass layer can comprise, for example, face fiber material extending from the substrate, the substrate comprising a primary backing layer 102 material. The components of the artificial grass layer can be made from any materials known in the art and commonly used in the art of artificial turf. Similarly, the infill layer disposed on the substrate and interspersed between the pile fibers can comprise any infill substantially rubber-free materials commonly used in the art of artificial turf.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the invention.

While the disclosure has been described with reference to exemplary embodiments, it will be understood by those skilled in the art that various changes may be made, and equivalents may be substituted for elements thereof without departing from the scope of the disclosure. In addition, many modifications may be made to adapt a particular system, device, or component thereof to the teachings of the disclosure without departing from the essential scope thereof. Therefore, it is intended that the disclosure is not limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A synthetic turf system substantially at least partially free of crumb rubber infill and shock pads, comprising:

a water-porous backing layer;

a synthetic turf having a plurality of synthetic turf strands, wherein the synthetic turf is infilled with a plurality of sand particles and a plurality of cooling particles and spread at least partially uniform throughout the synthetic turf, and wherein the sand particles are at least partially coated with a super absorbent polymer, and wherein the synthetic turf is infilled with less than 1% of rubber particles or crumb rubber; and a poured-in-place (PIP) rubber subsurface secured to the backing layer;

wherein the PIP rubber subsurface is not dispersed and provides buoyancy;

wherein the PIP rubber subsurface is poured with a mixture of rubber buffing and urethane aromatic polyurethane binder compacted and configured to deliver ASTM F1292 standards for impact attenuation for the synthetic turf placed on a playing surface;

wherein the binder constitutes 5 wt. % to 30 wt. % of the final subsurface;

wherein 5-35% of the volume of the compacted PIP rubber subsurface consists of air-filled cavities;

wherein the PIP rubber subsurface buffing comprises elongated strands having a length to width aspect ratio of at least and having a thickness between about 0.5 mm and about 2.0 mm and a length between about 3.0 mm and about 20.0 mm;

wherein the synthetic turf is attached to the PIP rubber subsurface using a rolled edge or a tucked edge.

2. The synthetic turf system of claim 1, wherein the mixture utilizes 8 to 32 pounds of urethane per 100 pounds of rubber buffing.

3. The synthetic turf system of claim 2, wherein the poured-in-place (PIP) rubber subsurface provides for vertical drainage from about 10 in/h to about 7,000 in/h of fluid flow according to ASTM D3385 standard.

4. The synthetic turf system of claim 3, wherein the synthetic turf infill comprises at least 75 wt. % or more of sand by dry bulk weight in an amount from about 3 to about 10 pounds of sand per square foot of synthetic turf.

5. The synthetic turf system of claim 4, wherein at least 10% of the volume of the poured-in-place (PIP) rubber subsurface comprises air-filled cavities.

6. The synthetic turf system of claim 1, further comprising:

a first sub-layer underneath the PIP rubber subsurface configured to allow water to pass through; and a second sub-layer beneath the first sub-layer.

7. The synthetic turf system of claim 6, wherein the mixture utilizes 8 to 32 pounds of urethane per 100 pounds of rubber buffing.

8. The synthetic turf system of claim 6, wherein the first sub-layer is compacted gravel layer.

9. The synthetic turf system of claim 6, wherein the second sub-layer is sub-grade water drainage.

10. The synthetic turf system of claim 7, wherein the synthetic turf infill comprises at least 75 wt. % or more of sand by dry bulk weight in an amount from about 3 to about 10 pounds of sand per square foot of synthetic turf.

11. The synthetic turf system of claim 10, wherein at least 5% of the volume of the poured-in-place (PIP) rubber subsurface comprises air-filled cavities and wherein the poured-in-place (PIP) rubber subsurface provides for vertical drainage from about 10 in/h to about 7,000 in/h of fluid flow according to ASTM D3385 standard.

* * * * *